US008417173B2

(12) United States Patent
Sakuma

(10) Patent No.: US 8,417,173 B2
(45) Date of Patent: Apr. 9, 2013

(54) POWDER RECOVERY DEVICE AND IMAGE FORMING APPARATUS

(75) Inventor: Masaru Sakuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 12/875,203

(22) Filed: Sep. 3, 2010

(65) Prior Publication Data

US 2011/0222940 A1 Sep. 15, 2011

(30) Foreign Application Priority Data

Mar. 12, 2010 (JP) ..... 2010-056167

(51) Int. Cl.
*G03G 21/12* (2006.01)

(52) U.S. Cl.
USPC ..... 399/360

(58) Field of Classification Search ..... 399/358, 399/360
See application file for complete search history.

(56) References Cited

U.S. PATENT DOCUMENTS 6,167,211 A * 12/2000 Oogi et al. ..... 399/53
7,991,344 B2 * 8/2011 Naruse ..... 399/358
2004/0052560 A1 3/2004 Ishii et al.
2005/0220515 A1 * 10/2005 Wakana ..... 399/358
2006/0120779 A1 * 6/2006 Uchihashi ..... 399/358
2006/0204282 A1 9/2006 Yoshida et al.
2007/0242993 A1 * 10/2007 Tanaka ..... 399/358

FOREIGN PATENT DOCUMENTS

JP 11-102107 A 4/1999
JP 2001-265112 A 9/2001
JP 2004-102137 A 4/2004
JP 2006-163032 A 6/2006
JP 2006-251286 A 9/2006

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A powder recovery device includes a powder storage container and at least two powder conveying members. The powder storage container stores powder recovered from a recovery port. The at least two powder conveying members are disposed on upper and lower sides of the recovery port interposed therebetween in the powder storage container, and are disposed in a longitudinal direction of the powder storage container. The at least two powder conveying members are set so that the amount of powder conveyed near the recovery port is larger than the amount of powder conveyed to a back side which is on the opposite side of the recovery port in the longitudinal direction.

10 Claims, 14 Drawing Sheets

POWDER RECOVERY DEVICE AND IMAGE FORMING APPARATUS

CROSS-REFERENCE TO RELATED APPLICATION

This application is based on and claims priority under 35 USC 119 from Japanese Patent Application No. 2010-056167 filed on Mar. 12, 2010.

BACKGROUND

1. Technical Field

The present invention relates to a powder recovery device and an image forming apparatus using the powder recovery device.

2. Related Art

An image forming apparatus includes a powder recovery device. The powder recovery device conveys powder to a powder storage container, which is recovered from a developing device or recovered from a cleaning device, and stores the recovered powder in the powder storage container.

SUMMARY

According to an aspect of the invention, a powder recovery device includes a powder storage container and at least two powder conveying members. The powder storage container stores powder recovered from a recovery port. The at least two powder conveying members are disposed on upper and lower sides of the recovery port interposed therebetween in the powder storage container, and are disposed in a longitudinal direction of the powder storage container. The at least two powder conveying members are set so that the amount of powder conveyed near the recovery port is larger than the amount of powder conveyed to a back side which is on the opposite side of the recovery port in the longitudinal direction.

BRIEF DESCRIPTION OF THE DRAWINGS

Exemplary embodiments of the invention will be described in detail based on the following figures, wherein.

DETAILED DESCRIPTION

An embodiment of the invention will be described below with reference to drawings.

Figure 2:
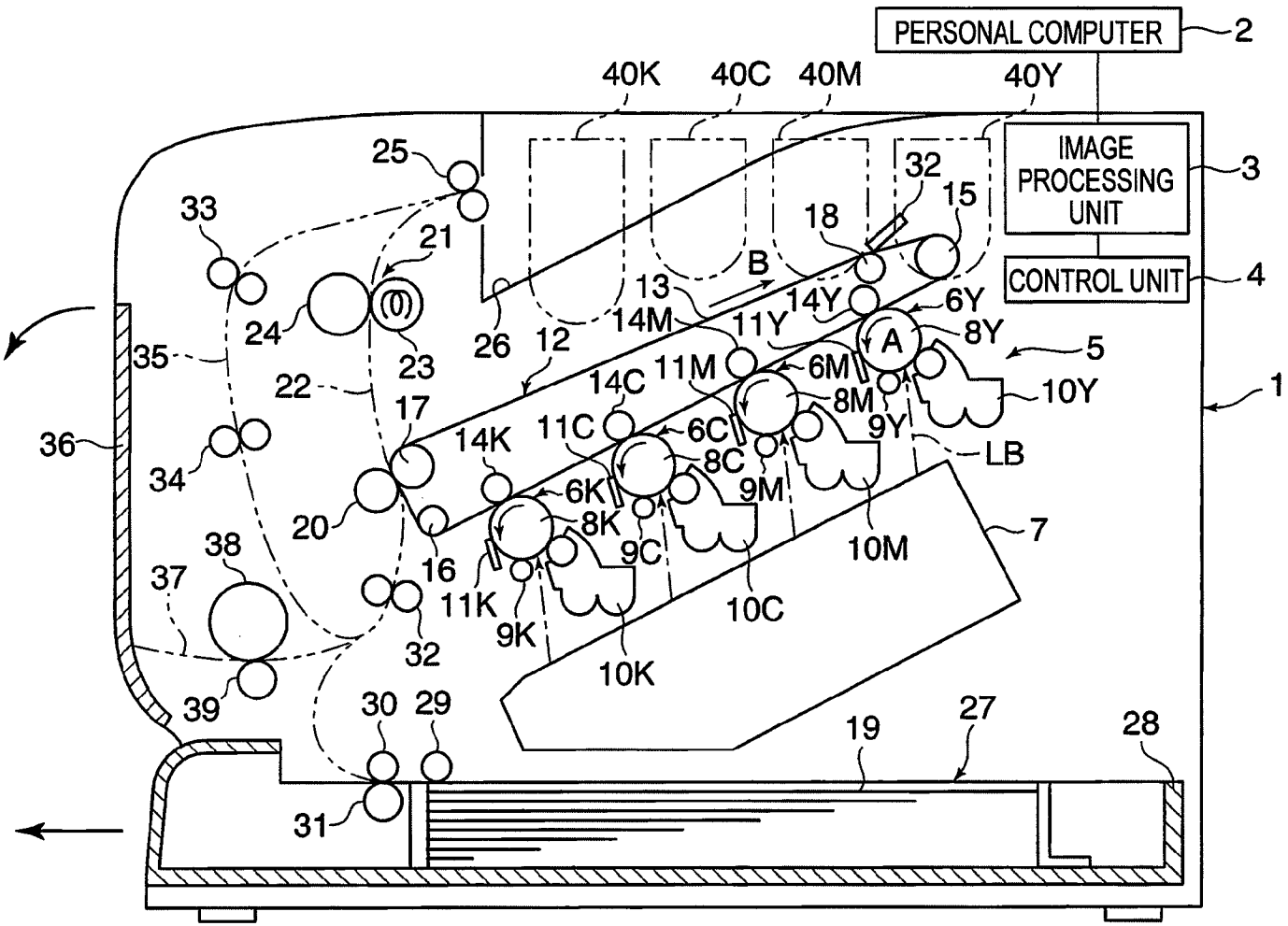
FIG. 2 is a view showing the structure of a tandem type color printer as an image forming apparatus to which the powder recovery device according to the first embodiment of the invention is applied.

FIG. 2 is a view showing the structure of a tandem type color printer as an image forming apparatus to which a powder recovery device according to a first embodiment of the invention is applied.

As shown in FIG. 2, the color printer outputs a full color or monochrome image according to image data output from a personal computer, an image reading device (not shown), or the like, or image data sent through a telephone line, a LAN, or the like.

As shown in FIG. 2, an image processing unit 3 and a control unit 4 for controlling the entire color printer are provided in the color printer main body 1. The image processing unit performs predetermined image processing, such as shading correction, displacement correction, brightness/color space conversion, gamma correction, frame elimination, and color/movement editing, on image data sent from a personal computer (PC) 2, an image reading device (not shown), or the like, as occasion demands.

Further, the image data, which have been subjected to the predetermined image processing in the image processing unit 3 as described above, are converted into image data corresponding to four colors, that is, yellow (Y), magenta (M), cyan (C), and black (K), by the image processing unit 3. Then, as described below, the image data are output as a full color image or a monochrome image by an image output unit 5 provided in the color printer main body 1.

As shown in FIG. 2, four image forming units (image forming section) 6Y, 6M, 6C, and 6K corresponding to yellow (Y), magenta (M), cyan (C), and black (K) are disposed in parallel at regular intervals in the color printer main body 1 and are inclined to the horizontal direction by a predetermined angle so that the first color image forming unit 6Y corresponding to yellow (Y) is relatively high and the last color image forming unit 6K corresponding to black (K) is relatively low.

If the four image forming units 6Y, 6M, 6C, and 6K corresponding to yellow (Y), magenta (M), cyan (C), and black (K) are disposed so as to be inclined by a predetermined angle as described above, it may be possible to set the distance between the image forming units 6Y, 6M, 6C, and 6K to a distance smaller than a distance between the four image forming units 6Y, 6M, 6C, and 6K that are disposed in the horizontal direction. Accordingly, the width of the color printer main body 1 is reduced, so that it may be possible to further reduce the size of the color printer.

These four image forming units 6Y, 6M, 6C, and 6K have basically the same structure except for the color of an image to be formed. As shown in FIG. 2, each of the four image forming units broadly includes a photoreceptor drum 8 as an image holding member that is rotationally driven at a predetermined speed in the direction of an arrow A by drive means (not shown), a primary charging roller 9 that uniformly charges the surface of the photoreceptor drum 8 with electricity, an image exposure device 7 that forms an electrostatic latent image on the surface of the photoreceptor drum 8 by exposing an image according to image data corresponding to a predetermined color, a developing device 10 that develops the electrostatic latent image formed on the photoreceptor drum 8 with toner corresponding to a predetermined color, and a cleaning device 11 that cleans the surface of the photoreceptor drum 8.

As the photoreceptor drum 8, there is used, for example, a member that is formed in the shape of a drum having a diameter of about 30 mm and of which the surface is coated with a photoreceptor layer formed of an organic photoconductor (OPC). The photoreceptor drum is rotationally driven at a predetermined speed in the direction of an arrow A by a drive motor (not shown).

Further, as the charging roller 9, there is used, for example, a roller-like charger of which the surface of a metal core is coated with a conductive layer. The conductive layer is made of a synthetic resin or synthetic rubber, and the electrical resistance of the conductive layer has been adjusted. A predetermined charging bias is applied to the metal core of the charging roller 9.

As shown in FIG. 2, the image exposure device 7 is common to the four image forming units 6Y, 6M, 6C, and 6K. The image exposure device forms electrostatic latent images, which corresponding to image data, by irradiating laser beams LB, which are deflected and emitted according to corresponding color image data, to the surfaces of the respective photoreceptor drums 8Y, 8M, 8C, and 8K. Meanwhile, the image exposure device 7 is not limited to a device using the laser beams LB, and a device using a LED array, which is disposed so as to correspond to the respective photoreceptor drums, may also be used as the image exposure device.

Corresponding color image data are sequentially output from the image processing unit 3 to the image exposure device 7 that is provided so as to be common to the respective image forming units 6Y, 6M, 6C, and 6K corresponding to yellow (Y), magenta (M), cyan (C), and black (K). The surfaces of the corresponding photoreceptor drums 8Y, 8M, 8C, and 8K are scanned and exposed by laser beams LB, which are emitted from the image exposure device 7 according to image data. Accordingly, electrostatic latent images corresponding to the image data are formed. The electrostatic latent images formed on the photoreceptor drums 8Y, 8M, 8C, and 8K are developed as color toner images, which correspond to yellow (Y), magenta (M), cyan (C), and black (K), by the developing devices 10Y, 10M, 10C, and 10K.

The respective color toner images corresponding to yellow (Y), magenta (M), cyan (C), and black (K), which are sequentially formed on the photoreceptor drums 8Y, 8M, 8C, and 8K of the respective image forming units 6Y, 6M, 6C, and 6K, are primarily, sequentially, and multiply transferred to an intermediate transfer belt 13 as an intermediate transfer body of an intermediate transfer body unit 12, which is disposed above the respective image forming units 6Y, 6M, 6C, and 6K so as to be inclined, by four primary transfer rollers 14Y, 14M, 14C, and 14K.

The intermediate transfer belt 13 is an endless belt member that is stretched by a plurality of rollers, and is inclined to the horizontal direction so that a lower side running area of the belt member is relatively low on the downstream side in a running direction of the belt member and relatively high on the upstream side in the running direction.

That is, as shown in FIG. 2, the intermediate transfer belt 13 is stretched with a predetermined tension among a driving roller 15, a driven roller 16, a driven roller 18, and a back surface supporting roller 17 of a secondary transfer portion. The intermediate transfer belt is rotated at a predetermined speed in the direction of an arrow B by the driving roller 15 that is rotationally driven by a drive motor (not shown) having an excellent constant speed property. As the intermediate transfer belt 13, there is used, for example, a member that is formed of a synthetic resin film made of polyimide, polyamide-imide, or the like, having flexibility in the shape of an endless belt. The intermediate transfer belt 13 is disposed so as to come into contact with the photoreceptor drums 8Y, 8M, 8C, and 8K of the respective image forming units 6Y, 6M, 6C, and 6K in the lower side running area.

Further, as shown in FIG. 2, a secondary transfer roller 20 as secondary transfer means is disposed at a lower end of the upper running area of the intermediate transfer belt 13 so as to come into contact with the surface of the intermediate transfer belt 13 that is stretched by the back surface supporting roller 17. The secondary transfer means secondarily transfers the toner images, which have been primarily transferred to the intermediate transfer belt 13, to a recording medium 19.

The respective color toner images corresponding to yellow (Y), magenta (M), cyan (C), and black (K), which have been multiply transferred to the intermediate transfer belt 13, are secondarily and collectively transferred to a recording sheet 19 as a recording medium by the secondary transfer roller 20, which comes into contact with the back surface supporting roller 17 with the intermediate transfer belt 13 interposed therebetween, as shown in FIG. 2. The recording sheet 19 to which the respective color toner images have been transferred is conveyed to a fixing device 21, which is positioned on the upper side in a vertical direction, along a sheet conveying path 22. The secondary transfer roller 20 comes into press contact with the back surface supporting roller 17 in a lateral direction with the intermediate transfer belt 13 interposed therebetween, and secondarily and collectively transfers the respective color toner images to the recording sheet 19 that is conveyed from the lower side to the upper side in the vertical direction.

As the secondary transfer roller 20, there is used, for example, a member that is formed by coating the outer periphery of a metal core with an elastic layer with a predetermined thickness. The metal core is made of metal such as stainless steel, and the elastic layer is formed of a conductive elastic body made of a synthetic rubber material or the like to which a conductive agent is added.

Further, the recording sheet 19 to which the respective color toner images have been transferred is subjected to fixing processing by heat and pressure, which are applied by a heating roller 23 and a pressure belt (or a pressure roller) 24 of the fixing device 21. Then, the recording sheet is discharged onto a discharge tray 26, which is provided at an upper end portion of the printer main body 1, by a discharge roller 25 so that the surface of the recording sheet on which the images are formed faces the lower side.

While being separated one by one by a sheet feed roller 29 and a pair of sheet separation roller 30 and 31, the recording sheets 19, which have a predetermined size and are made of a predetermined material, are fed from a sheet feed tray 28 of a sheet feed device 27 disposed at the bottom in the printer main body 1 as shown in FIG. 2 and are conveyed once to a registration roller 32. Further, the recording sheet 19, which is fed from the sheet feed tray 28, is sent to a secondary transfer position of the intermediate transfer belt 13 by the registration roller 32 that is rotationally driven in synchronization with the toner images formed on the intermediate transfer belt 13. A thick sheet or the like, such as coated paper of which one surface or both surfaces are coated, may be fed as the recording sheet 19, in addition to plain paper. A photo image or the like is also output on the recording sheet 19 formed of coated paper.

Meanwhile, as shown in FIG. 2, residual toner is removed from the surface of the photoreceptor drum 8, on which a primary transfer process for the toner image has been finished, by the cleaning device 11, and the surface of the photoreceptor drum prepares for the next image forming process.

Meanwhile, as shown in FIG. 2, residual toner and the like are removed from the surface of the intermediate transfer belt 13, on which a secondary transfer process for the toner image has been finished, by a belt cleaning device 32 that is disposed near the upstream side of the driving roller 15, and the surface of the intermediate transfer belt prepares for the next image forming process.

Further, when images are to be formed on both surfaces of the recording sheet 19, the recording sheet 19, which has images formed on one surface thereof, is not discharged as it is onto the discharge tray 26, which is provided at the upper end portion of the printer main body 1, by the discharge roller 25 and the discharge roller 25 is rotated in a reverse direction and a sheet conveying path is switched to an upper conveying path 35 for both surface on which the conveying rollers 33 and 34 are disposed while the rear end of the recording sheet 19 is held by the discharge roller 25. Then, the recording sheet 19, which has been turned over, is conveyed again to the registration roller 32, and images are formed on the back surface of the recording sheet 19.

Meanwhile, recording sheets 19, which have a desired size and are made of a desired material, may also be supplied to the color printer from not only the sheet feed tray 28 but also a manual tray 36. The manual tray 36 is provided on the front of the printer main body 1, which is shown on the left side in FIG. 1, so as to be freely opened and closed. While being separated one by one through a manual conveying path 37 by a pair of sheet separation conveying rollers 38 and 39, recording sheets 19 disposed on the manual tray 36 are fed and conveyed to the registration roller 32.

Meanwhile, reference numerals 40Y, 40M, 40C, and 40K in FIG. 2 denote toner cartridges that supply toner or powder (toner and carrier) corresponding to the colors of the respective developing devices 10Y, 10M, 10C, and 10K corresponding to yellow (Y), magenta (M), cyan (C), and black (K).

As shown in FIG. 2, powder including at least corresponding color toner is supplied from the toner cartridges 40Y, 40M, 40C, and 40K to the developing devices 10Y, 10M, 10C, and 10K of the respective image forming units 6Y, 6M, 6C, and 6K corresponding to yellow (Y), magenta (M), cyan (C), and black (K); and is used for development. Further, surplus powder G is discharged from the respective developing devices 10Y, 10M, 10C, and 10K.

Figure 3:
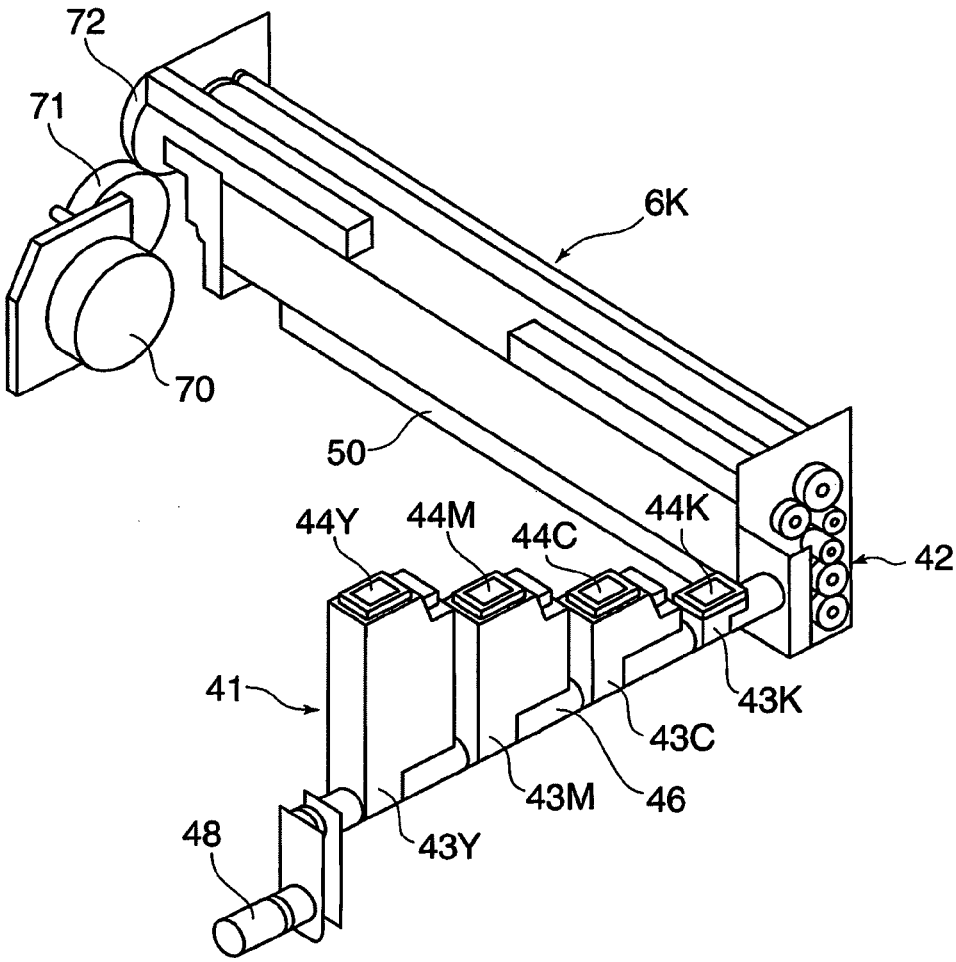
FIG. 3 is a perspective view showing main parts of a tandem type color printer as the image forming apparatus to which the powder recovery device according to the first embodiment of the invention is applied.
Figure 4:
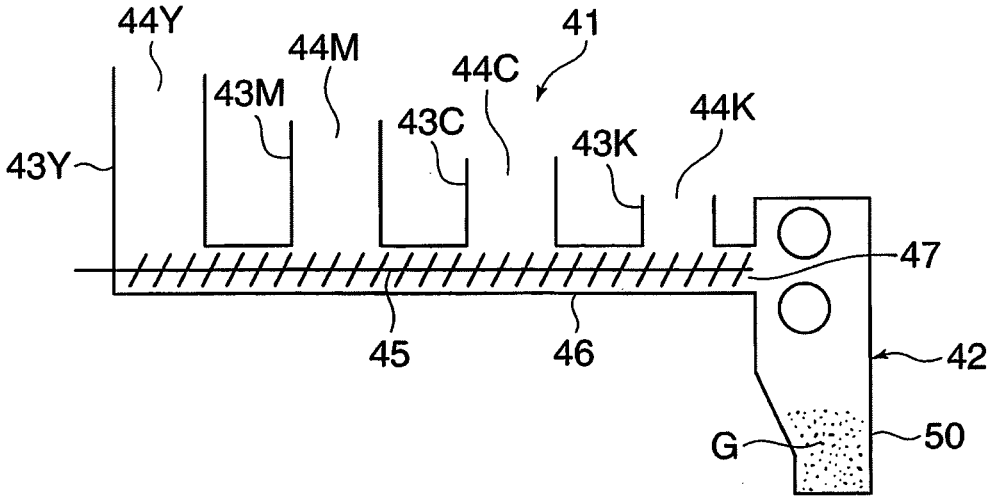
FIG. 4 is a schematic view showing the structure of a powder conveying device and the powder recovery device.

As shown in FIG. 3 and FIG. 4, the surplus powder G discharged from the respective developing devices 10Y, 10M, 10C, and 10K is conveyed to the powder recovery device 42 by a powder conveying device 41 as powder conveying means that is disposed on one side of the printer main body 1. The powder conveying device 41 includes conveying cylindrical portions 43Y, 43M, 43C, and 43K for conveying the surplus powder G, which is discharged from the respective developing devices 10Y, 10M, 10C, and 10K, to the lower side. Powder receiving ports 44Y, 44M, 44C, and 44K, through which the surplus powder G discharged from the outlets of the respective developing devices 10Y, 10M, 10C, and 10K are received, are opened upward at upper end portions of the conveying cylindrical portions 43Y, 43M, 43C, and 43K at positions corresponding to the heights of the respective developing devices 10Y, 10M, 10C, and 10K.

In the powder conveying device 41, the surplus color powder G received from the powder receiving ports 44Y, 44M, 44C, and 44K is dropped by one's own weight and is conveyed into the powder recovery device 42 from a recovery port 47 through a cylindrical conveying passage 46 which is disposed in the horizontal direction at the lower end portion of the powder conveying device 41 and in which a conveying auger 45 is disposed. Meanwhile, reference numeral 48 in FIG. 3 denotes a drive motor for rotationally driving the conveying auger 45.

Figure 1:
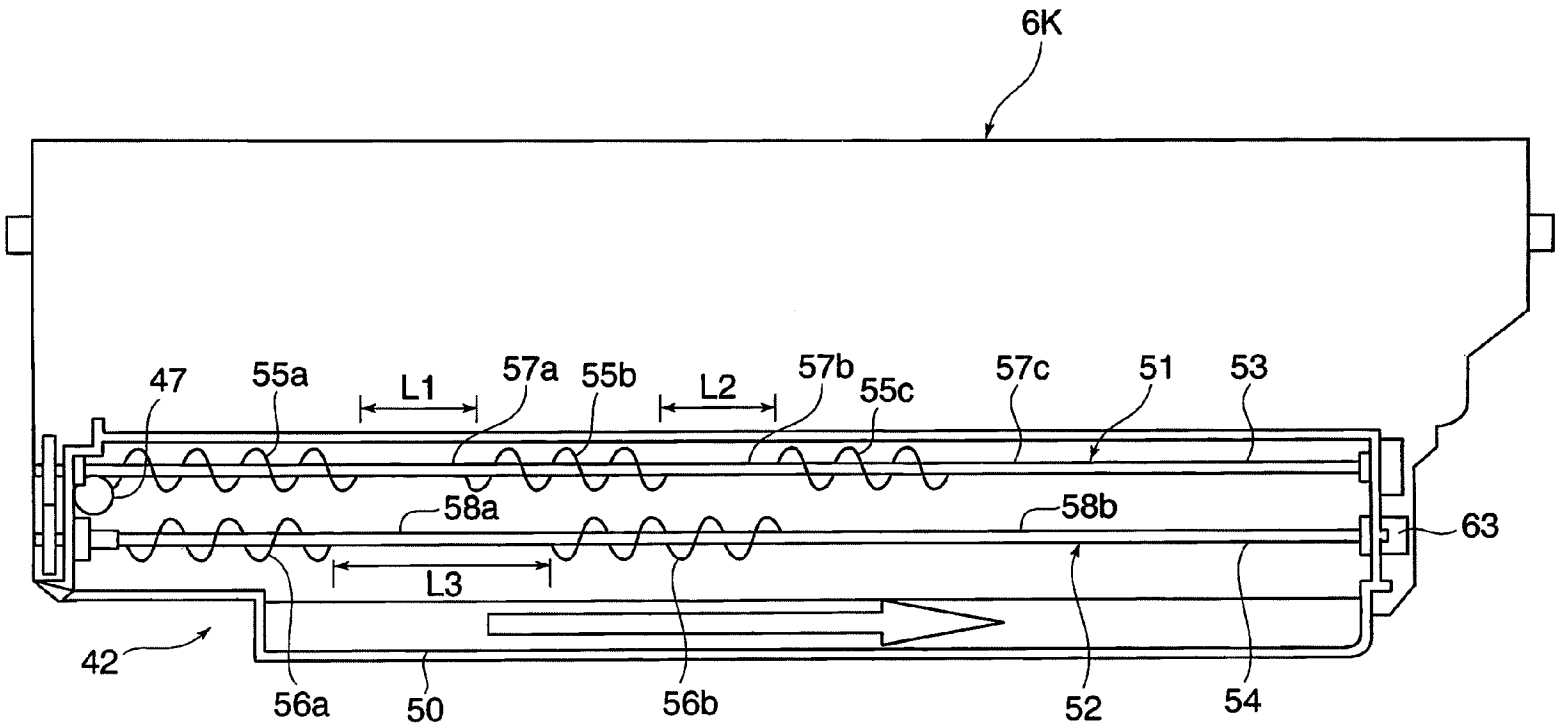
FIG. 1 is a cross-sectional view of a powder recovery device according to a first embodiment of the invention.

Further, as shown in FIG. 3, the powder recovery device 42 is disposed in the depth direction of the printer main body 1 parallel to the photoreceptor drum 8 so as to be adjacent to the lower portion of the image forming unit 6K corresponding to black (K). As shown in FIG. 4, the powder recovery device 42 includes a powder storage container 50 of which the lower end portion is thinly formed so as to have a substantially triangular cross-section. As shown in FIG. 1 and FIG. 4, the powder storage container 50 is formed in an elongated shape so that the dimension of the powder storage container in the depth direction is larger than that in a height direction, and the recovery port 47, through which the surplus powder G is recovered from the outside, is opened at an upper portion of one end portion of the powder storage container 50.

Furthermore, as shown in FIG. 1, at least two (first and second) powder conveying members 51 and 52 are disposed parallel to each other on the upper and lower sides in a vertical direction in the powder storage container 50 with the recovery port 47 interposed therebetween. The powder conveying members convey the powder which is recovered through the recovery port 47, to the back side in the longitudinal direction of the powder storage container 50. Meanwhile, in the shown embodiment, there has been described a case where first and second (two) powder conveying members 51 and 52 disposed on the upper and lower sides are used as the powder conveying members. However, three or more powder conveying members may be used.

As shown in FIG. 1, the first and second powder conveying members 51 and 52 include rotating shafts 53 and 54 and spiral conveying blades 55 and 56. The rotating shafts 53 and 54 are rotationally driven in a predetermined direction. The spiral conveying blades 55 and 56 are formed on the outer peripheries of the rotating shafts 53 and 54 and separated into a plurality of pieces (formed intermittently) at predetermined intervals in the axial direction. As shown in FIG. 1, the first powder conveying member 51, which is disposed on the upper side, includes a first conveying blade 55*a*, a second conveying blade 55*b*, a third conveying blade 55*c*, and a third bladeless area 57*c*. The first conveying blade 55*a* is disposed close to the powder recovery port 47. The second conveying blade 55*b* is disposed on the outer periphery of the rotating shaft 53 with a bladeless area 57*a* where a conveying blade is not formed in the axial direction by a predetermined first interval L1. The third conveying blade 55*c* is disposed on the outer periphery of the rotating shaft 53 with a second bladeless area 57*b* where a conveying blade is not formed in the axial direction by a predetermined second interval L2. The third bladeless area 57*c*, where a conveying blade is not formed on the outer periphery of the rotating shaft 53, is formed on the downstream side of the third conveying blade 55*c* up to the end of the rotating shaft in the axial direction.

Figure 5:
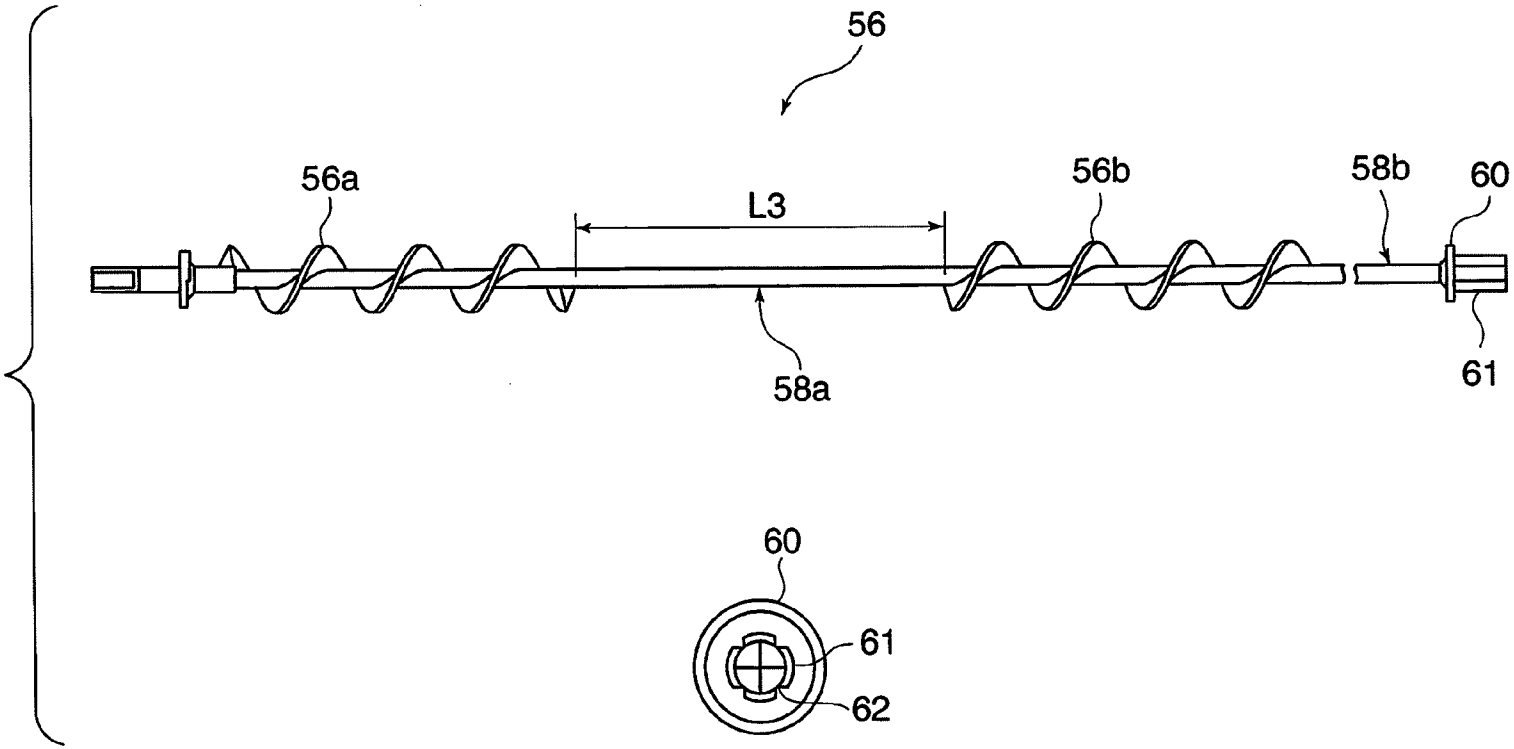
FIG. 5 is a view showing the structure of a second powder conveying member.

Further, as shown in FIG. 5, the second powder conveying member 52, which is disposed on the lower side, includes a first conveying blade 56*a*, a second conveying blade 56*b*, and a second bladeless area 58*b*. The first conveying blade 56*a* is disposed close to the powder recovery port 47. The second conveying blade 56*b* is disposed on the outer periphery of the rotating shaft 54 with a first bladeless area 58*a* where a conveying blade is not formed in the axial direction by a predetermined third interval L3. The second bladeless area 58*b*, where a conveying blade is not formed on the outer periphery of the rotating shaft 54, is formed on the downstream side of the second conveying blade 56*b* up to the end of the rotating shaft in the axial direction.

As shown in FIG. 1, the first powder conveying member 51 includes the first to third conveying blades 55*a* to 55*c*, and the second powder conveying member 52 includes the first and second conveying blades 56*a* and 56*b*. The amount of powder, which is conveyed in the axial direction per unit time by the first powder conveying member 51 disposed on the upper side, is set to be larger than the amount of powder that is conveyed in the axial direction per unit time by the second powder conveying member 52 disposed on the lower side.

Further, as shown in FIG. 4, the first conveying blades 55*a* and 56*a* of the first and second powder conveying members 51 and 52 are disposed close to the recovery port 47 on the upper and lower sides. Accordingly, the amount of powder, which is conveyed per unit time by the first conveying blades 55*a* and 56*a* of the first and second powder conveying members 51 and 52, is set to be larger than the amount of powder that is conveyed per unit time by the conveying auger 45 for conveying the powder G to the recovery port 47 of the powder recovery device 42. For this reason, the recovered powder G does not stay near an end portion that corresponds to the recovery port 47 in the powder storage container 50.

Furthermore, when seen in the axial direction of the rotating shafts 53 and 54, as shown in FIG. 1, the first and second powder conveying members 51 and 52 includes the first conveying blades 55*a* and 56*a* that are formed at the end portions thereof corresponding to the recovery port 47 and are disposed on the upper and lower sides. Meanwhile, the second conveying blades 55*b* and 56*b* and the third conveying blade 55*c* are disposed on the side opposite to the recovery port 47, that is, on the back side so that the positions thereof are offset from each other in the axial direction of the rotating shafts 53 and 54. Accordingly, the amount of powder, which is conveyed per unit time near the recovery port 47, is larger than the amount of powder that is conveyed per unit time on the back side of the powder storage container 50.

Moreover, as shown in FIG. 1, the second conveying blade 56*b* of the second powder conveying member 52 is disposed at a deviated position on the downstream side of the second conveying blade 55*a* of the first powder conveying member 51 in the axial direction, and is set so as to form a peak of the powder G between the first and second conveying blades 55*a* and 55*b* of the first powder conveying member 51 and between the first and second conveying blades 56*a* and 56*b* of the second powder conveying member 52.

In addition, as shown in FIG. 1, the second conveying blade 56*b* of the second powder conveying member 52 is disposed from a position corresponding to an intermediate position of the second conveying blade 55*b* of the first powder conveying member 51 over a position corresponding to an upstream end portion of the third conveying blade 55*c* in the axial direction.

Figure 6:
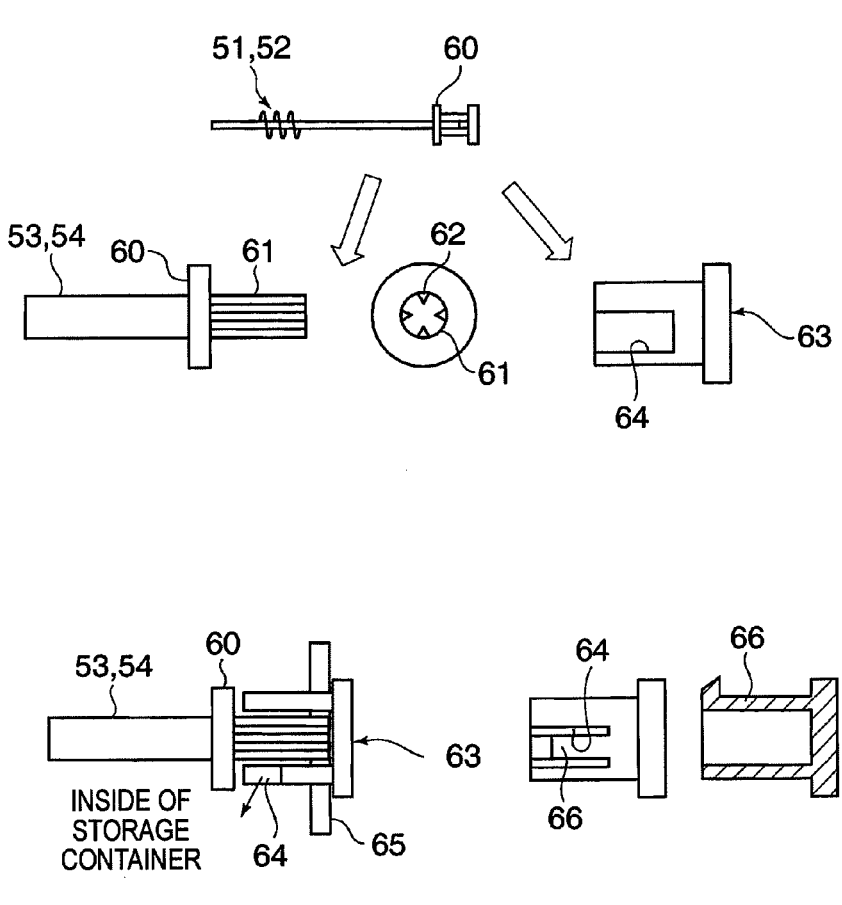
FIG. 6 is a view showing a supporting structure of the second powder conveying member.

As shown in FIG. 5 and FIG. 6, flanges 60 are formed at the back end portions of the rotating shafts 53 and 54 of the first and second powder conveying members 51 and 52, particularly, at the second powder conveying member 52 that is disposed on the lower side. A plurality of grooves 62, which extends in the axial direction, is formed on the outer peripheral surfaces of support portions 61 of the rotating shafts 53 and 54, which are positioned at the end portions of the flanges 60, in a circumferential direction. In the shown embodiment, four grooves are formed at positions corresponding to an interval of 90°.

Further, as shown in FIG. 6, at least one or more (one in the shown embodiment) cutout portions 64, which extend in the axial direction, are formed in the circumferential direction at bearing members 63 where the support portions 61 of the rotating shafts 53 and 54 are rotatably supported.

Meanwhile, a snap fit 66, which is used to mount the bearing member 63 on the side wall 65 of the powder storage container 50, is formed integrally with the cutout portion 64.

Figure 7:
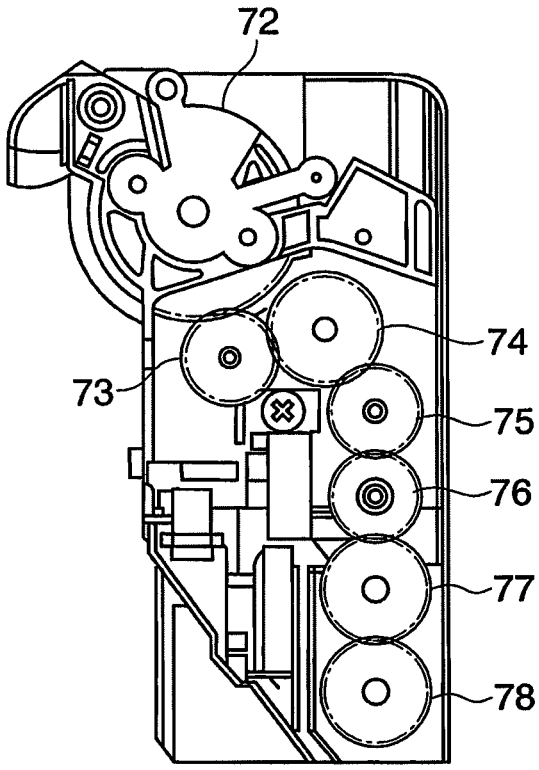
FIG. 7 is a view showing a drive mechanism of the powder recovery device.

As shown in FIG. 3, the powder recovery device 42 is rotationally driven by a photoreceptor motor 70 that rotationally drives the photoreceptor drum 8K of the image forming unit 6K corresponding to black. A rotational drive force of the photoreceptor motor 70 is transmitted to a photoreceptor gear 72, which is provided at one end of the photoreceptor drum 8K in the axial direction, through a driven gear 71. Further, as shown in FIG. 7, the rotational drive force of the photoreceptor gear 72 is transmitted to a cleaning gear 74, which rotationally drives an agitator (not shown) of the cleaning device 11K of the image forming unit 6K corresponding to black, through a driven gear 73, which meshes with the photoreceptor gear 72. Further, the cleaning gear 74 meshes with the driving gears 77 and 78, which are fixed to driving ends of the rotating shafts 53 and 54 of the first and second powder conveying members 51 and 52, through the driven gears 75 and 76.

The rotational direction of the rotating shafts 53 and 54 of the first and second powder conveying members 51 and 52, which are rotationally driven by the driving gears 77 and 78, are opposite to each other. Meanwhile, since the powder conveying directions of the first and second powder conveying members 51 and 52 are equal to each other, the conveying blades 55 and 56 formed on the outer peripheries of the rotating shafts 53 and 54 are formed so that the rotational directions of the spirals of the conveying blades are opposite to each other as shown in FIG. 1.

According to the above-mentioned structure, it may be possible to increase the amount of powder, which is recovered into the powder storage container, by the followings in the color printer to which the powder recovery device according to this embodiment is applied.

That is, as shown in FIG. 2, in the color printer, electrostatic latent images corresponding to image data are formed on the photoreceptor drums 8Y, 8M, 8C, and 8K of the respective image forming units 6Y, 6M, 6C, and 6K corresponding to yellow (Y), magenta (M), cyan (C), and black (K). The electrostatic latent images formed on the photoreceptor drums 8Y, 8M, 8C, and 8K become toner images by being developed by the developing devices 10Y, 10M, 10C, and 10K. After being multiply transferred to the intermediate transfer belt 13, the respective color toner images corresponding to yellow (Y), magenta (M), cyan (C), and black (K) formed on the photoreceptor drums 8Y, 8M, 8C, and 8K are secondarily and collectively transferred to the recording sheet 19 and fixed. As a result, full color or monochrome images are formed.

In this case, toner is gradually consumed in the developing devices 10Y, 10M, 10C, and 10K, and toner is supplied from the toner cartridges 40Y, 40M, 40C, and 40K at a predetermined timing as toner is consumed.

Further, surplus powder is gradually discharged from the developing devices 10Y, 10M, 10C, and 10K. As shown in FIG. 3 and FIG. 4, the surplus powder discharged from the developing devices 10Y, 10M, 10C, and 10K is conveyed to the powder conveying device 41 and recovered to the powder storage container 50 of the powder recovery device 42 by the powder conveying device 41.

Meanwhile, in the respective image forming units 6Y, 6M, 6C, and 6K corresponding to yellow (Y), magenta (M), cyan (C), and black (K), as shown in FIG. 3 and FIG. 4, the powder recovered by the cleaning devices 11Y, 11M, 11C, and 11K is also conveyed to the powder conveying device 41 and recovered to the powder storage container 50 of the powder recovery device 42 by the powder conveying device 41.

As shown in FIG. 1, the powder, which is recovered to the powder storage container 50 of the powder recovery device 42 by the powder conveying device 41, is recovered into the powder storage container 50 from the recovery port 47 that is formed at one end portion of the powder storage container 50.

Figure 8:
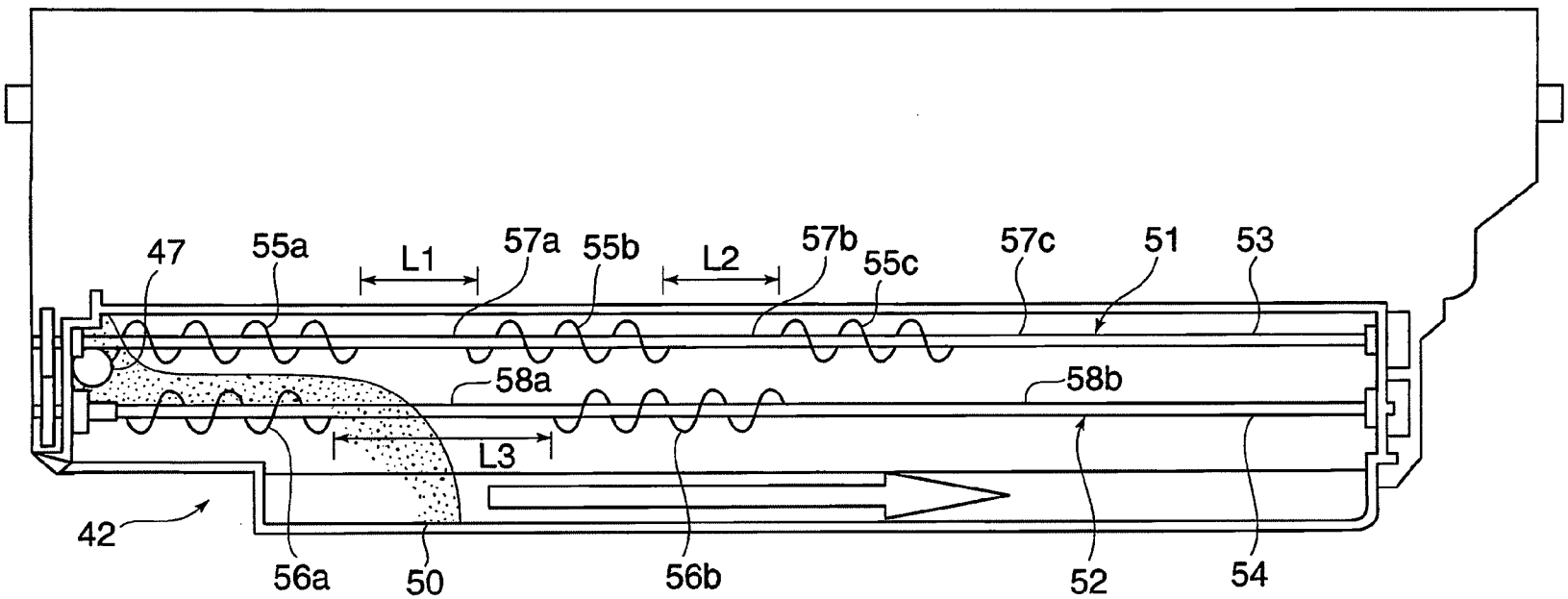
FIG. 8 is a cross-sectional view showing the operation of the powder recovery device according to the first embodiment of the invention.

As shown in FIG. 1, in the powder storage container 50, the first and second powder conveying members 51 and 52 with the recovery port 47 interposed therebetween are disposed parallel to each other in the longitudinal direction of the powder storage container 50. For this reason, as shown in FIG. 8, the powder G, which is recovered into the powder storage container 50 from the recovery port 47, is agitated and conveyed to the back side in the longitudinal direction of the powder storage container 50 by the first and second powder conveying members 51 and 52 that are rotationally driven in synchronization with the powder conveying device 41.

In this case, as shown in FIG. 1, the first conveying blades 55*a* and 55*b* are provided at the end portions of the first and second powder conveying members 51 and 52 corresponding to the recovery port 47. Accordingly, the powder G, which is recovered into the powder storage container 50 from the recovery port 47, is conveyed to the back side of the powder storage container 50 by the first conveying blades 55*a* and 55*b*.

Figure 9:
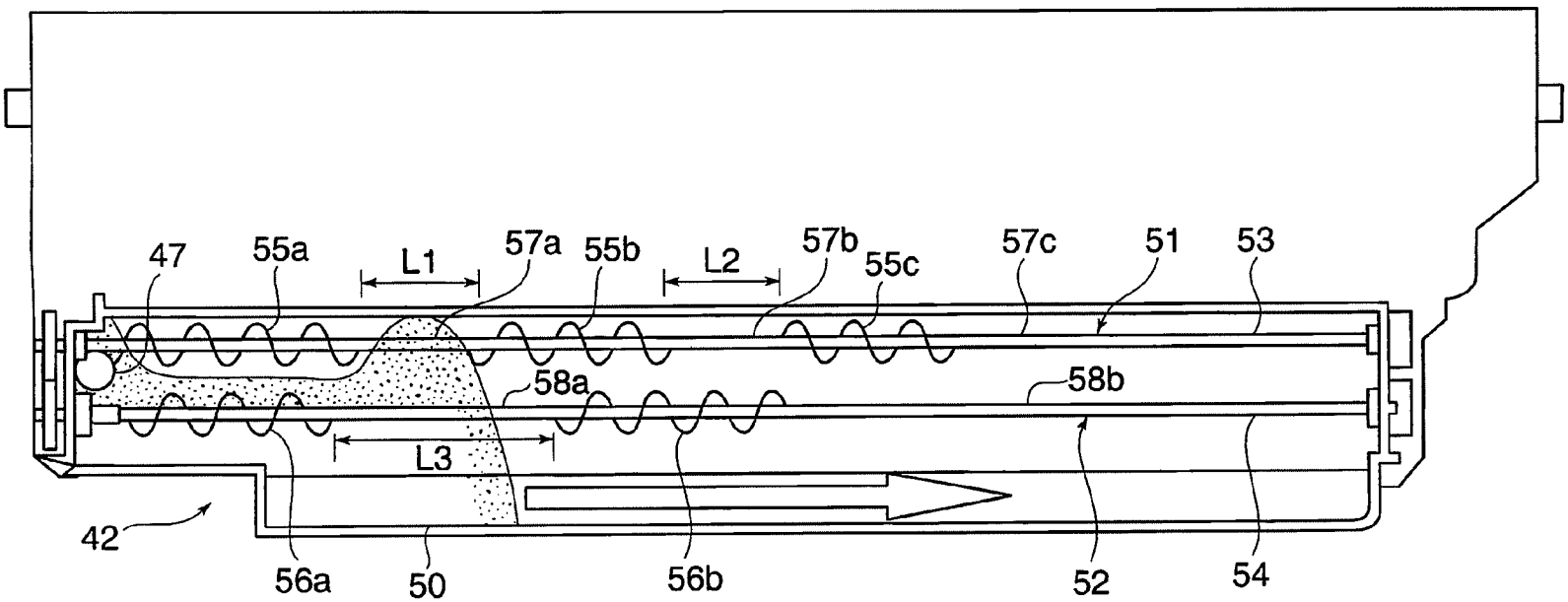
FIG. 9 is a cross-sectional view showing the operation of the powder recovery device according to the first embodiment of the invention.

However, since the first conveying blades 55*a* and 55*b* of the first and second powder conveying members 51 and 52 are provided at an end portion corresponding to the recovery port 47 by a predetermined length, the powder conveyed by the first conveying blades 55*a* and 55*b* forms a peak on the downstream side in the axial direction of the first conveying blades 55*a* and 55*b* as shown in FIG. 9.

Figure 10:
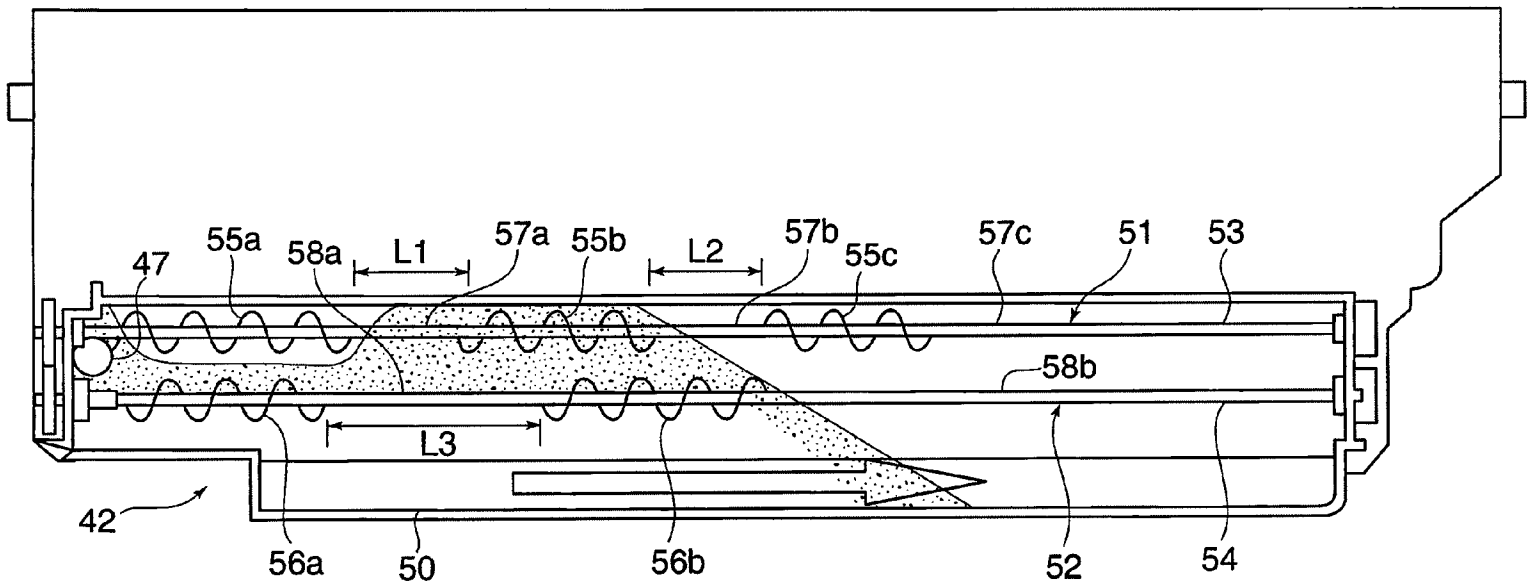
FIG. 10 is a cross-sectional view showing the operation of the powder recovery device according to the first embodiment of the invention.

After that, if the peak of the powder G, which is formed on the downstream side in the axial direction of the first conveying blades 55*a* and 55*b*, gradually increases, as shown in FIG. 10, the peak of the powder reaches the upstream end portion of the second conveying blade 55*b* of the first powder conveying member 51 and is further conveyed to the downstream side by the second conveying blade 55*b*. Accordingly, the peak of the powder G is deposited so that the base of the peak of the powder is widened toward the back side. In this case, the base portion of the peak of the powder G, which is positioned on the back side, is conveyed to the downstream side by the second conveying blade 56*b* of the second powder conveying member 52. Accordingly, the peak of the powder G is deposited so that the base of the peak of the powder is further widened toward the back side.

Figure 11:
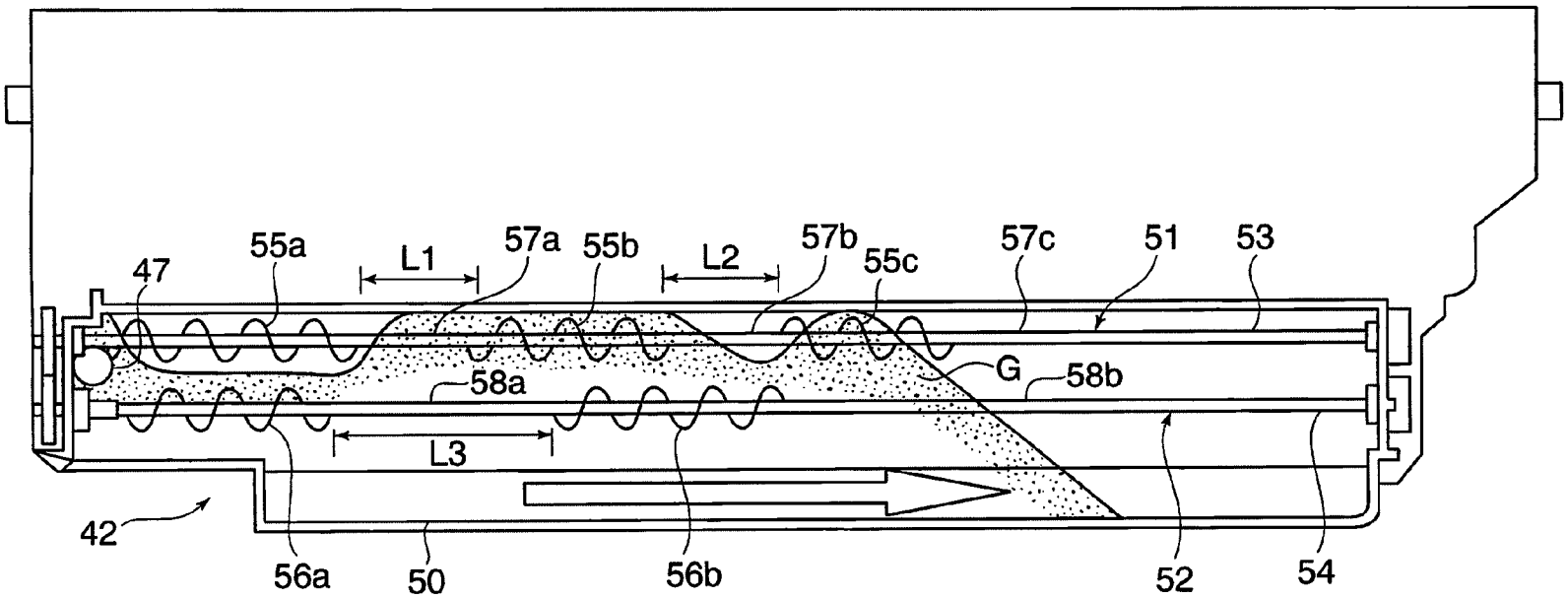
FIG. 11 is a cross-sectional view showing the operation of the powder recovery device according to the first embodiment of the invention.

Further, the peaks of the powder which are formed on the downstream side in the axial direction of the first conveying blades 55*a* and 56*a* and the second conveying blades 55*b* and 56*b*, gradually increase, as shown in FIG. 11, the peaks of the powder reach the upstream end portion of the third conveying blade 55*c* of the first powder conveying member 51 and is further conveyed to the downstream side by the third conveying blade 55*c*. Accordingly, the peak of the powder G is deposited so that the base of the peak of the powder is widened toward the back side.

Figure 12:
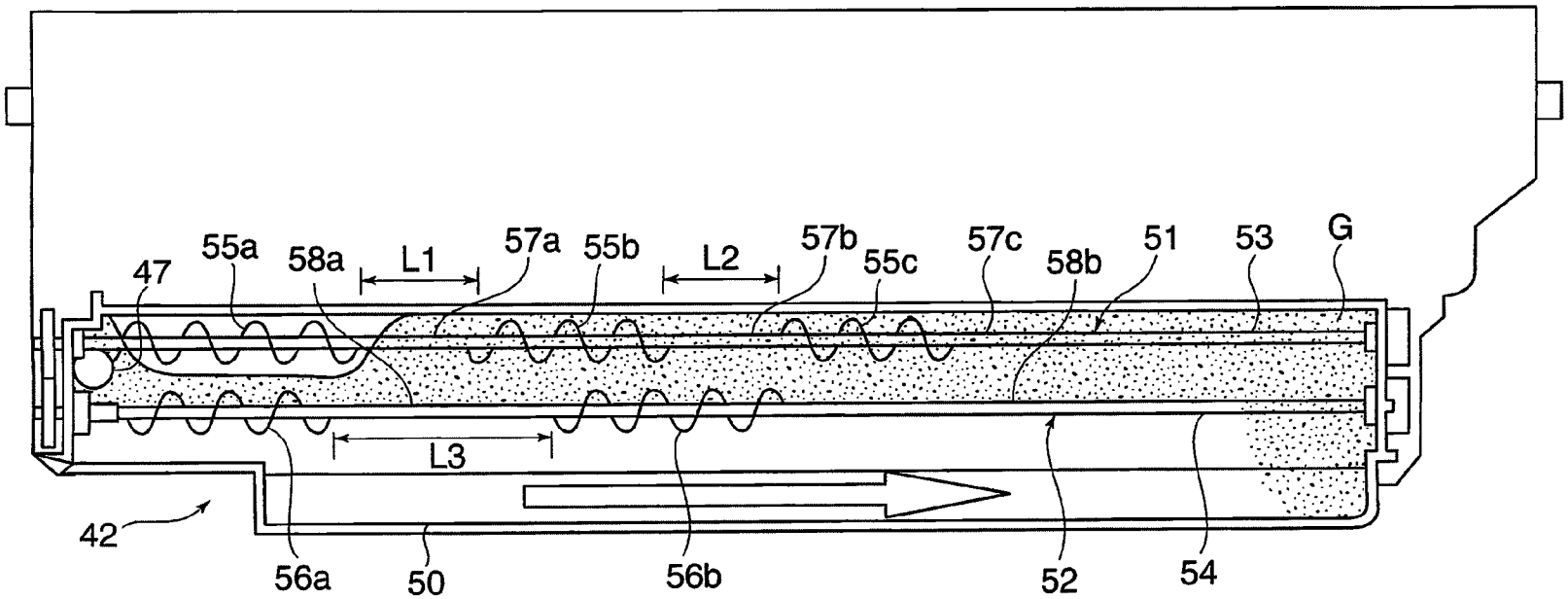
FIG. 12 is a cross-sectional view showing the operation of the powder recovery device according to the first embodiment of the invention.

After that, if the powder G, which is conveyed to the downstream side in the axial direction by the first conveying blades 55*a* and 56*a*, the second conveying blades 55*b* and 56*b*, and the third conveying blade 55*c* of the first and second powder conveying members 51 and 52, is conveyed to the downstream side by the third conveying blade 55*c* of the first powder conveying member 51, so that the base of the peak of the powder G reaches the back end portion of the powder storage container 50 as shown in FIG. 12.

Then, the base of the powder G, which is conveyed to the downstream side by the third conveying blade 55*c* of the first powder conveying member 51, gradually becomes high and gradually fills the back end portion of the powder storage container 50 by a conveying force of the third conveying blade 55*c*.

As a result, it may be possible to recover powder until the powder storage container 50 is almost fully filled. Further, it may be possible to considerably increase the amount of powder G, which is recovered into the powder storage container 50, as compared to the related art.

Furthermore, the inventor made a prototype of the powder recovery device 42 shown in FIG. 1, and performed experiments for confirming the change in the amount of powder G recovered into the powder storage container 50 and the drive torque that rotationally drives the first and second powder conveying members 51 and 52.

In this case, the change in drive torque was confirmed by using a powder conveying member that had grooves formed at a support portion of a rotating shaft and a powder conveying member that did not have grooves formed at a support portion of a rotating shaft.

Further, there was performed an experiment for confirming the generation of abnormal noise and the like by stopping the recovery of the powder G and idling the powder conveying members when the amount of powder G recovered into the powder storage container 50 reached 700 g.

Figure 13:
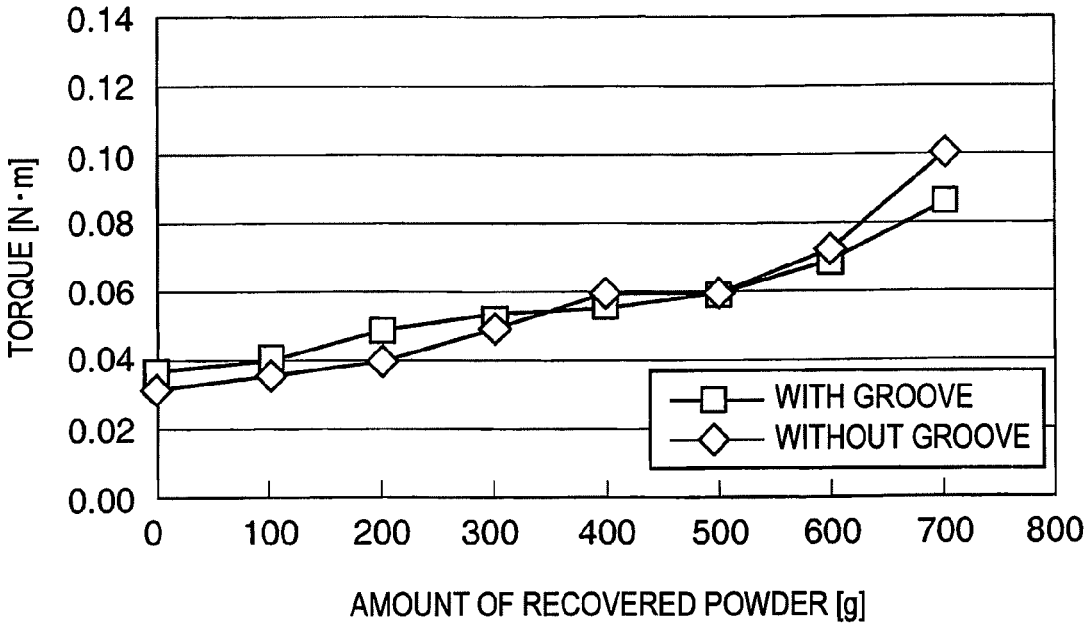
FIG. 13 is a graph showing the experimental results of the powder recovery device according to the first embodiment of the invention.
Figure 14:
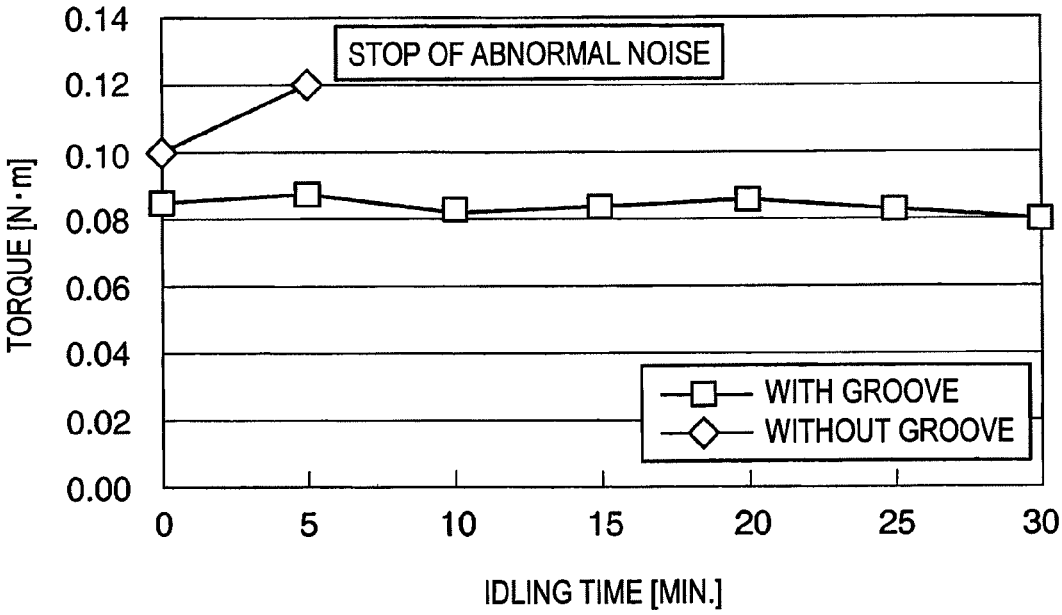
FIG. 14 is a graph showing the experimental results of the powder recovery device according to the first embodiment of the invention.

FIG. 13 and FIG. 14 are graphs showing the results of the example of the experiment.

As apparent from FIG. 13, it was found as follows: 700 g of powder could be recover by the powder conveying member that had grooves 62 formed at the support portion 61 of the rotating shaft 54 and the powder conveying member that did not have grooves 62 formed at the support portion 61 of the rotating shaft 54, and the amount of recovered powder was considerably increased as compared to 470 g of powder recovered in a comparative example. However, in the case of the powder conveying member that did not have grooves 62 formed at the support portion 61 of the rotating shaft 54, drive torque was suddenly increased when the amount of recovered powder reached 700 g. Meanwhile, in the comparative example, there were used a first powder conveying member where conveying blades were continuously formed over the entire length thereof, and a second powder conveying member where conveying blades were continuously formed up to the middle portion thereof from the recovery port 47.

It is thought to be that the increase in drive torque was due to the fact that recovered powder G got into the space between the support portion 61 of the rotating shaft 54 and the bearing member 63 and the powder G became fixed due to friction therebetween.

Further, if the recovery of the powder G was stopped and the powder conveying members were idled when the amount of powder G recovered into the powder storage container 50 reached 700 g, abnormal noise was generated after about 5 minutes as shown in FIG. 14 in the case of the powder conveying member that did not have grooves 62 formed at the support portion 61 of the rotating shaft 54. For this reason, the second powder conveying member 52 could not be rotationally driven and stopped.

As described above, the reason for this is thought to be that the recovered powder G got into the space between the support portion 61 of the rotating shaft 54 and the bearing member 63 and the powder G became fixed due to friction therebetween.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder recovery device comprising:

a powder storage container that stores powder recovered from a recovery port; and at least two powder conveying members (i) that are disposed on upper and lower sides of the recovery port interposed therebetween in the powder storage container, (ii) that are disposed in a longitudinal direction of the powder storage container, and (iii) that are set so that the amount of powder conveyed near the recovery port is larger than the amount of powder conveyed to a back side which is on the opposite side of the recovery port in the longitudinal direction.

2. The powder recovery device according to claim 1, wherein the at least two powder conveying members include rotating shafts which are rotationally driven, and conveying blades which are formed in a spiral shape on an outer periphery of the rotating shafts, and the amount of powder conveyed by the respective powder conveying members in axial directions thereof is set by forming the conveying blades only at a part of the rotating shafts in the axial directions.

3. The powder recovery device according to claim 1, wherein the at least two powder conveying members are set so that the amount of powder conveyed by the powder conveying member, which is disposed on the upper side of the recovery port, is larger than the amount of powder conveyed by the powder conveying member, which is disposed on the lower side of the recovery port.

4. The powder recovery device according to claim 1, wherein the powder conveying member, which is disposed on the upper side of the recovery port, of the at least two powder conveying members includes:

a first conveying blade that is provided in an axial direction of a rotating shaft of the powder conveying member in an area corresponding to the recovery port; and at least a plurality of second and third conveying blades that are provided adjacent to the first conveying blade through bladeless areas, where conveying blades are not formed, interposed therebetween.

5. The powder recovery device according to claim 4, wherein the powder conveying member, which is disposed on the lower side of the recovery port, of the at least two powder conveying members includes:

a first conveying blade that corresponds to a first conveying blade of the powder conveying member disposed on the upper side of the recovery port and that is set to be shorter than the first conveying blade of the powder conveying member disposed on the upper side; and a second conveying blade that is provided from an intermediate portion of a second conveying blade of the powder conveying member disposed on the upper side, over an end of a third conveying blade of the powder conveying member disposed on the upper side.

6. The powder recovery device according to claim 1, wherein the powder conveying member, which is disposed on the lower side of the recovery port, of the at least two powder conveying members includes:

a first conveying blade that corresponds to a first conveying blade of the powder conveying member disposed on the upper side of the recovery port and that is set to be shorter than the first conveying blade of the powder conveying member disposed on the upper side; and a second conveying blade that is provided from an intermediate portion of a second conveying blade of the powder conveying member disposed on the upper side, over an end of a third conveying blade of the powder conveying member disposed on the upper side.

7. The powder recovery device according to claim 1, wherein the at least two powder conveying members include a plurality of grooves which extend in an axial direction of the at least two powder conveying members and is formed in a circumferential direction on outer peripheral surfaces of one end portions of a rotating shafts of the powder conveying members.

8. The powder recovery device according to claim 1, wherein at least one or more cutout portions, which extend in an axial direction of the powder conveying members, are formed in a circumferential direction at bearing members which support the rotating shafts of the at least two powder conveying members.

9. A powder recovery device comprising:

a powder storage container that stores powder recovered from a recovery port; and at least two powder conveying members (i) that are disposed on upper and lower sides of the recovery port interposed therebetween in the powder storage container, (ii) that are disposed in a longitudinal direction of the powder storage container, (iii) that are set so that the amount of powder conveyed near the recovery port is larger than the amount of powder conveyed by a conveying unit for conveying powder to the recovery port from outside of the powder storage container, and (iv) that are set so that the amount of powder conveyed to a back side which is on the opposite side of the recovery port in the longitudinal direction is smaller than the amount of powder conveyed to the recovery port.

10. An image forming apparatus comprising:

a plurality of image forming sections that forms images having different colors;

a powder conveying section that conveys powder recovered from the plurality of image forming sections to a powder storage container;

the powder storage container that stores powder recovered from a recovery port; and at least two powder conveying members (i) that are disposed on upper and lower sides of the recovery port interposed therebetween in the powder storage container, (ii) that are disposed in a longitudinal direction of the powder storage container, and (iii) that are set so that the amount of powder conveyed near the recovery port is larger than the amount of powder conveyed to a back side which is on the opposite side of the recovery port in the longitudinal direction of the powder storage container and is larger than the amount of powder conveyed by the powder conveying section.

* * * * *